US009951631B2

(12) United States Patent
Skura et al.

(10) Patent No.: US 9,951,631 B2
(45) Date of Patent: Apr. 24, 2018

(54) TURBOMACHINE ROTOR BLADE

(71) Applicant: MTU Aero Engines AG, Munich (DE)

(72) Inventors: Krzysztof Skura, Majdan Krolewski (PL); Marcin Kozdras, Krosno (PL); Lukasz Sosnowka, Rzeszow (PL); Manfred Feldmann, Eichenau (DE); Manfred Schill, Munich (DE)

(73) Assignee: MTU Aero Engines AG, Munich (DE)

( * ) Notice: Subject to any disclaimer, the term of this patent is extended or adjusted under 35 U.S.C. 154(b) by 664 days.

(21) Appl. No.: 14/316,035

(22) Filed: Jun. 26, 2014

(65) Prior Publication Data

US 2015/0003988 A1 Jan. 1, 2015

(30) Foreign Application Priority Data

Jun. 27, 2013 (EP) ..... 13174031

(51) Int. Cl.
*F04D 29/08* (2006.01)
*F01D 5/30* (2006.01)

(52) U.S. Cl.
CPC ..... *F01D 5/3007* (2013.01); *F05D 2250/292* (2013.01); *F05D 2250/38* (2013.01); *F05D 2250/712* (2013.01)

(58) Field of Classification Search
CPC .... F01D 5/3007; F01D 11/001; F01D 11/005; F01D 11/006; F01D 11/008; F05D 2250/292; F05D 2250/38; F05D 2250/712
See application file for complete search history.

(56) References Cited

U.S. PATENT DOCUMENTS

| | | | | |
|---|---|---|---|---|
| 4,497,613 | A * | 2/1985 | Carreno | F01D 5/16 416/228 |
| 4,595,340 | A | 6/1986 | Klassen et al. | |
| 5,435,694 | A * | 7/1995 | Kray | F01D 5/141 416/219 R |
| 5,924,699 | A * | 7/1999 | Airey | F01D 11/008 277/411 |
| 7,547,192 | B2 * | 6/2009 | Caruso | F01D 5/225 416/190 |
| 7,549,846 | B2 * | 6/2009 | Dube | F01D 5/147 416/193 A |
| 2011/0293408 | A1 | 12/2011 | Feldmann et al. | |
| 2013/0243604 | A1 * | 9/2013 | Roussille | D03D 25/005 416/241 A |
| 2013/0294927 | A1 * | 11/2013 | Dimmick, III | F01D 11/006 416/219 R |

FOREIGN PATENT DOCUMENTS

| | | |
|---|---|---|
| DE | 10 2009 007664 | 8/2010 |
| EP | 2 586 967 | 5/2013 |
| GB | 1 062 170 | 3/1967 |

* cited by examiner

*Primary Examiner* — Christopher Verdier
*Assistant Examiner* — Kayla McCaffrey
(74) *Attorney, Agent, or Firm* — Davidson, Davidson & Kappel, LLC

(57) ABSTRACT

A rotor blade for a turbomachine, including an airfoil (1) for flow deflection, a blade root (2) for attachment to a rotor of the turbomachine, an inner platform (3) between the airfoil and the blade root, and at least one pocket (4, 5) defined by two axially spaced walls (4.1, 4.2; 5.1, 5.2) extending from the side of the platform opposite the airfoil toward the blade root. A first (4.1, 5.1) of these walls has an outer side (4.1A, 5.1A) that faces away from the pocket and, in at least one cross section perpendicular to a radial longitudinal axis of the rotor blade, slopes outwardly.

13 Claims, 1 Drawing Sheet

TURBOMACHINE ROTOR BLADE

This claims the benefit of European Patent Application EP 13174031.8, filed Jun. 27, 2013 and hereby incorporated by reference herein.

The present invention relates to a rotor blade for a turbomachine, as well as a turbomachine, in particular a gas turbine, having such a rotor blade.

BACKGROUND

German Patent Application DE 10 2009 007 664 A1 describes a rotor blade for a turbomachine, including an airfoil for flow deflection, a blade root for attachment to a rotor of the turbomachine, an inner platform between the airfoil and the blade root, as well as a pocket defined by two axially spaced walls extending from the side of the platform opposite the airfoil toward the blade root. These walls are offset relative to a blade root edge toward a radial longitudinal axis for improved mechanical loading. The outer sides of these walls, which face away from the pocket, are parallel relative to the circumferential direction.

U.S. Pat. No. 4,595,340 also describes a rotor blade having an inwardly tapering pocket between an inner platform and a blade root for improved mechanical loading. The outer sides facing away from the pocket are also parallel relative to the circumferential direction.

As a result of the sloped, tapering inner sides and circumferentially parallel outer sides, the wall thickness increases in a circumferential direction toward the bottom of the pocket. An arrangement of two such pockets opposite each other in the circumferential direction results, in particular, in an accumulation of material in the region of the airfoil.

SUMMARY OF THE INVENTION

It is an object of an embodiment of the present invention to provide an improved turbomachine.

In accordance with an aspect of the present invention, a rotor blade for a turbomachine has an airfoil for deflection, including a pressure side, a suction side, a leading edge and a trailing edge (with respect to the flow direction during operation of the turbomachine).

A blade root is connected to the airfoil, in particular integrally to form a single piece therewith, for purposes of attachment of the rotor blade to a rotor of the turbomachine. The blade root may, in particular, be configured as a so-called fir-tree root and have one or more projections that engage behind corresponding undercuts of a groove in the rotor and thereby fixedly attach, in particular radially fixedly attach, the rotor blade to the rotor.

Disposed between the airfoil and the blade root is a platform (a radially inner platform in the mounted state), which defines a radially inner boundary of a flow duct for a working fluid of the turbomachine. References to directions, such as "axial," "radial and "in a circumferential direction," are generally taken herein with respect to the mounted position of the rotor blade in the turbomachine.

In an embodiment, the inner platform has two opposite axial flanges to form labyrinth seals with adjacent stator vane assemblies. In this regard, reference is made to DE 10 2009 007 664 A1 or US 2011/0293408, the disclosure of which is expressly incorporated herein by reference.

The rotor blade is formed with a pocket on one or both of the sides that are opposite to each other in the circumferential direction. This pocket is defined in the axial direction by two axially spaced walls which extend from the side of the platform opposite the airfoil toward the blade root; i.e., in a radially inward direction, and are hereinafter referred to as first and second wall for the sake of brevity. The first wall may be an upstream or a downstream wall (with respect to the flow direction during operation of the turbomachine).

The pocket is defined radially outwardly by the side of the platform opposite the airfoil and, in the mounted state, it may be defined radially inwardly by the rotor. In an embodiment, the pocket is open; i.e., configured like a blind hole, on one side in a circumferential direction. Two circumferentially opposite pockets of a rotor blade may be bounded and separated by a common partition. In an embodiment, facing pockets of adjacent rotor blades, in particular the end faces of their first and second walls, as well as the inner platforms, may contact each other, so that their walls form two at least substantially closed, axially spaced sealing rings or flanges between the rotor and the inner platform ring.

In accordance with an aspect of an embodiment of the present invention, at least the first wall of one or two opposite pockets of the rotor blade has, in each case, an outer side or face which faces away from the pocket and which in one or more, preferably in at least substantially all cross sections perpendicular to a radial longitudinal axis of the rotor blade, slopes outwardly; i.e., away from the pocket, as viewed in a circumferential direction away from the blade. In other words, the outer side of the first wall diverges in an axial direction with increasing distance in a circumferential direction toward an adjacent rotor blade; i.e., toward an end face of the pocket; i.e., of the wall. Accordingly, the outer side converges or tapers axially inwardly; i.e., toward the pocket, in a circumferential direction from the end face of the first wall toward the rotor blade.

Thus, accumulation of material resulting from a tapering pocket can be reduced, which can be advantageous, in particular, for providing a draft angle.

In an embodiment, the second, axially opposite wall may also have an outer side which faces away from the pocket and which in one or more, preferably in at least substantially all cross sections perpendicular to the radial longitudinal axis, slopes outwardly; i.e., diverges in an axial direction with increasing distance in a circumferential direction toward an adjacent rotor blade; i.e., toward an end face of the pocket; i.e., of the wall, as viewed in a circumferential direction away from the blade.

In another embodiment, however, the outer side of the section wall is at least substantially oriented in the circumferential direction; i.e., parallel relative to the circumferential direction. Thus, in an embodiment, an advantageous draft angle may at least substantially be provided by the first wall, while the second walls form a sealing ring that is at least substantially parallel relative to the circumferential direction.

If the rotor blade has two circumferentially opposite pockets, the outer sides of the first walls may slope toward each other in a V-shaped manner.

In an embodiment, the outer side of the first wall is at least substantially parallel to an inner side or face of the first wall. Additionally or alternatively, the outer side of the second wall may be at least substantially parallel to the inner side or face of the second wall. This can be advantageous, especially in terms of manufacture and/or loading. Additionally or alternatively, in an embodiment, accumulation of material due to a draft angle can be minimized in this way.

The first and/or second wall may be curved axially inwardly, in particular parabolically, toward the pocket, as viewed in a radial direction, such as is explained in DE 10

2009 007 664 A1 or US 2011/0293408, which is made reference to also in this regard and the disclosure of which is incorporated herein by reference.

In a further embodiment, the first wall is curved axially inwardly, in particular parabolically, toward the pocket, as viewed in a radial direction, and its outer side, in each of at least one cross section perpendicular to the radial longitudinal axis in a radially outer half and at least one cross section perpendicular to the radial longitudinal axis in a radially inner half, slopes outwardly; i.e., diverges in an axial direction toward an open face of the pocket in a circumferential direction.

An outwardly sloping outer side may be curved, in particular uniformly and preferably strictly concavely curved, in at least one cross section perpendicular to the radial longitudinal axis of the rotor blade. An outwardly sloping outer side may also be at least substantially straight in at least one cross section perpendicular to the radial longitudinal axis of the rotor blade. In an embodiment, in at least one cross section perpendicular to the radial longitudinal axis of the rotor blade, a tangent plane on the outer side forms an angle of at least 5°, in particular at least 10° and/or no more than 45°, in particular no more than 30°, with the circumferential direction.

In an embodiment, at least the pocket and, in a refinement, also the airfoil integrally formed therewith and/or the blade root integrally formed therewith is/are formed by primary shaping, in particular by casting, and/or by secondary shaping, in particular by forging. In an embodiment, due to the sloping outer side(s), draft angles can be provided on a casting mold to facilitate removal of the pocket therefrom or on a forming tool, respectively, while reducing accumulations of material.

A rotor blade according to the present invention is advantageously used in a turbine or compressor stage of a gas turbine, in particular of an aircraft engine. Accordingly, in accordance with an aspect of the present invention, a turbomachine, in particular a gas turbine, and preferably an aircraft engine, includes a rotor and one or more of the above-described rotor blades which are attached by their roots to the rotor, in particular in a form-locking and/or detachable manner.

BRIEF DESCRIPTION OF THE DRAWINGS

Further advantageous features of the present invention will be apparent from the dependent claims and the following description of preferred embodiments. To this end, the drawings show, partly in schematic form, in:

DETAILED DESCRIPTION

Figure 1:
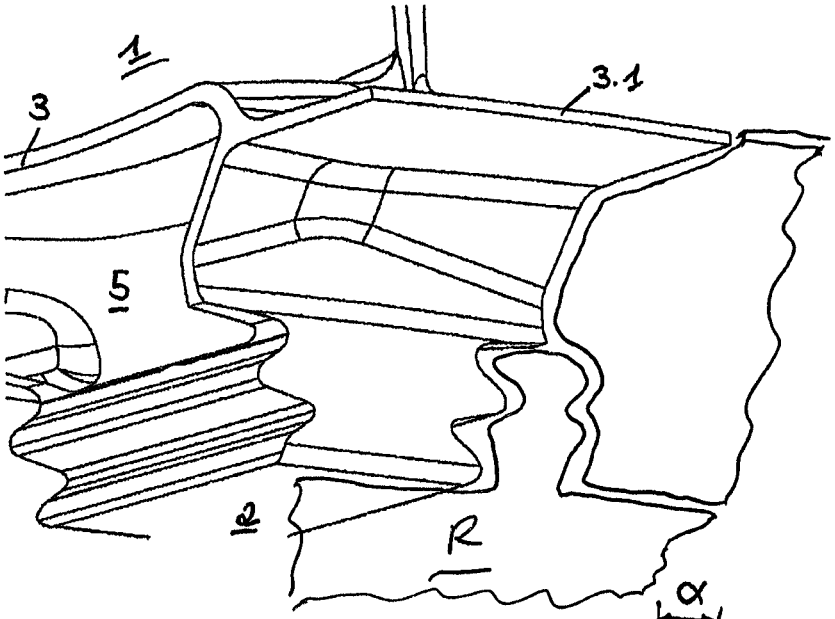
FIG. 1: a portion of a rotor blade of a gas turbine according to an embodiment of the present invention in a perspective view.
Figure 2:
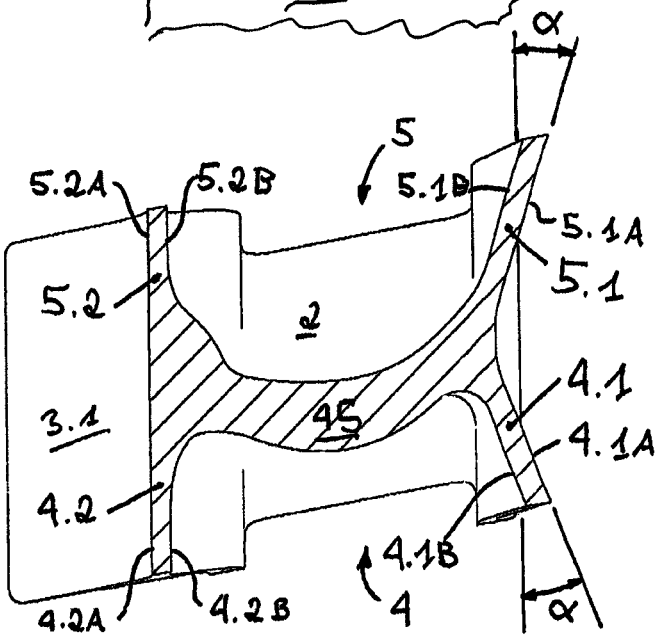
FIG. 2: a cross section of FIG. 1 perpendicular to a radial longitudinal axis of the rotor blade.

FIG. 1 shows a portion of a rotor blade of a gas turbine according to an embodiment of the present invention in a perspective view, and FIG. 2 shows a cross section of FIG. 1 perpendicular to a radial longitudinal axis of the rotor blade.

The rotor blade includes an airfoil 1 to which is connected a blade root 2 in the form of what is known as a fir-tree root. A second similar rotor blade (shown schematically) is adjacent to the rotor blade, with a pocket facing pocket 4.

Disposed between the airfoil and the blade root is an inner platform 3 having two axially opposite flanges, of which only a flange 3.1 can be seen in FIGS. 1, 2.

The rotor blade is formed with a pocket 4, respectively 5, on both sides that are opposite to each other in the circumferential direction (top and bottom in FIG. 2). Each of these pockets is defined in the axial direction (horizontally in FIG. 2) by a first wall 4.1, respectively 5.1, and a second wall 4.2, respectively 5.2, spaced axially apart from the respective first wall, the first and second walls extending from the side of platform 3 opposite the airfoil (at the bottom in FIG. 1) toward blade root 2; i.e., in a radially inward direction. The pocket 4, respectively 5, is defined radially outwardly (at the top in FIG. 1) by the side of platform 3 opposite the airfoil and, in the mounted state, it may be defined radially inwardly by a rotor (R, shown schematically) of the gas turbine, to which the rotor blade is detachably attached by its root 2. Pocket 4, respectively 5, is open on one side in a circumferential direction. Two circumferentially opposite pockets 4, 5 are separated by a common partition 45.

The first walls 4.1, 5.1 each have an outer side 4.1A, respectively 5.1A, (on the right in FIG. 2) which faces away from the pocket and, especially in the cross section shown in FIG. 2, slopes outwardly; i.e., diverges in an axial direction away from the pocket, as viewed in a circumferential direction toward an open face of the pocket. This means that, in the cross section shown, the lower outer side 4.1A in FIG. 2 diverges to the right when viewed from top to bottom, and the upper outer side 5.1A in FIG. 2 diverges to the right when viewed from bottom to top. Accordingly, when viewed from the end face of first wall 4.1 (from the bottom in FIG. 2) in a radial direction (upwardly in FIG. 2), outer side 4.1A converges inwardly toward airfoil 1; i.e., toward pocket 4, and when viewed from the end face of first wall 5.1 (from the top in FIG. 2) in a radial direction (downwardly in FIG. 2), outer side 5.1A converges toward airfoil 1.

Accordingly, outer sides 4.1A, 5.1A of first walls 4.1, 5.1 slope toward each other in a V-shaped manner.

In contrast, outer sides 4.2A, 5.2A of second walls 4.2, 5.2 are oriented in the circumferential direction (vertically in FIG. 2).

The outer sides 4.1A, 5.1A of first walls 4.1, 5.1 are parallel to the pocket-facing inner sides 4.1B, respectively 5.1B, of first walls 4.1, respectively 5.1. In addition, the outer sides 4.2A, 5.2A of second walls 4.2, 5.2 are parallel to the inner sides 4.2B, 5.2B of second walls 4.2, 5.2, so that the first and second walls have a constant thickness in the circumferential direction.

In this way, on the one hand, a draft angle is provided by the outwardly sloping or diverging first walls 4.1, 5.1, while on the other hand avoiding accumulation of material in the middle of the airfoil, in particular in the region of partition 45, as would occur in the case of circumferentially parallel outer sides.

First and second walls 4.1, 5.1, respectively 4.2, 5.2, of the two opposite pockets 4, 5 are parabolically curved inwardly toward the pocket as viewed in a radial direction (vertically in FIG. 1).

The outer sides 4.1A, 5.1A of first walls 4.1, 5.1 of pockets 4, 5 that face away from the pocket each slope outwardly in cross sections perpendicular to the radial longitudinal axis in a radially outer half (at the top in FIG. 1), of which one is shown in FIG. 2, and in cross sections perpendicular to the radial longitudinal axis in a radially inner half (at the bottom in FIG. 1). In the transition region between the two halves, the outer sides 4.1A, 5.1A, as well as the inner sides 4.1B, 5.1B parallel thereto, are substantially parallel relative to the circumferential direction due to the parabolic curvature.

The outer sides 4.1A, 5.1A facing and sloping away from the pocket are straight in substantially all cross sections perpendicular to a radial longitudinal axis of the rotor blade. In the embodiment shown in FIGS. 1, 2, the outer sides 4.1A, 5.1A of the two pockets 4, 5 merge in a radius located at the level of partition 45.

In the cross section shown in FIG. 2, the tangent planes on outer sides 4.1A, 5.1A form an angle $\alpha$ of about 20° with the circumferential direction.

Although the above is a description of exemplary embodiments, it should be noted that many modifications are possible. It should also be appreciated that the exemplary embodiments are only examples, and are not intended to limit scope, applicability, or configuration in any way. Rather, the foregoing description provides those skilled in the art with a convenient road map for implementing at least one exemplary embodiment, it being understood that various changes may be made in the function and arrangement of elements described without departing from the scope of protection set forth in the appended claims and their equivalent combinations of features.

LIST OF REFERENCE NUMERALS

1 airfoil
2 blade root
3 inner platform
3.1 axial flange
4; 5 pocket
4.1; 5.1 first wall
4.1A; 5.1A outer side
4.1B; 5.1B inner side
4.2; 5.2 second wall
4.2A; 5.2A outer side
4.2B; 5.2B inner side
45 partition

What is claimed is:

1. A rotor blade for a turbomachine, comprising:

an airfoil for flow deflection;

a blade root for attachment to a rotor of the turbomachine;

an inner platform between the airfoil and the blade root; and two axially spaced walls defining at least one pocket, the two axially spaced walls extending from the side of the platform opposite the airfoil toward the blade root;

the rotor blade being configured such that in the mounted state, facing pockets of adjacent rotor blades as well as the inner platforms, contact each other, so that their walls form two at least substantially closed, axially spaced sealing rings or flanges between the rotor and a ring defined by the inner platform, a first of the walls having an outer side facing away from the pocket and, in at least one cross section perpendicular to a radial longitudinal axis of the rotor blade, slopes outwardly as it extends in a circumferential direction, so that the outer side of the first wall diverges in an axial direction with increasing distance as it extends in the circumferential direction from the rotor blade toward a rotor blade that is circumferentially adjacent in the mounted state.

2. The rotor blade as recited in claim 1 wherein end faces of the axially spaced walls of the adjacent rotor blades contact each other in the mounted state.

3. The rotor blade as recited in claim 1 wherein a second of the walls has an outer side at least substantially oriented in the circumferential direction.

4. The rotor blade as recited in claim 1 wherein a second of the walls has an outer side facing away from the pocket and, in at least one cross section perpendicular to the radial longitudinal axis of the rotor blade, slopes outwardly.

5. The rotor blade as recited in claim 1 wherein at least one outer side facing away from the pocket is at least substantially parallel to a pocket-facing inner side of the wall.

6. The rotor blade as recited in claim 1 wherein at least one outwardly sloping outer side facing away from the pocket is curved or at least substantially straight in at least one cross section perpendicular to the radial longitudinal axis of the rotor blade.

7. The rotor blade as recited in claim 1 wherein the first or second wall is curved axially inwardly toward the pocket, as viewed in a radial direction.

8. The rotor blade as recited in claim 1 wherein the pocket is formed by casting.

9. The rotor blade as recited in claim 1 wherein the pocket is formed by forging.

10. The rotor blade as recited in claim 1 further comprising two further axially spaced walls defining a further pocket located opposite in a circumferential direction extending from the side of the platform opposite the airfoil toward the blade root, at least one first of the further walls having a further outer side facing away from the pocket and, in at least one cross section perpendicular to a radial longitudinal axis of the rotor blade, sloping outwardly.

11. A turbomachine comprising: a rotor and at least one rotor blade as recited in claim 1, the at least one rotor blade being attached to the rotor.

12. The turbomachine as recited in claim 11 wherein the rotor blade is attached to the rotor in a form-locking or detachable manner.

13. A gas turbine comprising the turbomachine as recited in claim 12.

* * * * *